United States Patent [19]

Lee et al.

[11] Patent Number: 5,019,796

[45] Date of Patent: May 28, 1991

[54] BAR MAGNET FOR CONSTRUCTION OF A MAGNETIC ROLLER CORE

[75] Inventors: James K. Lee, Brighton; Donald J. McJury, Brockport; Michael A. Pickup, Brighton; Kelly S. Robinson, Fairport, all of N.Y.

[73] Assignee: Eastman Kodak Company, Rochester, N.Y.

[21] Appl. No.: 455,117

[22] Filed: Dec. 22, 1989

[51] Int. Cl.[5] ..... H01F 7/02

[52] U.S. Cl. ..... 335/302; 335/306; 355/251

[58] Field of Search ..... 335/302, 3, 304–306; 355/521; 118/657

[56] References Cited

U.S. PATENT DOCUMENTS

| | | | |
|---|---|---|---|
| 4,354,454 | 10/1982 | Nishikawa | 355/251 |
| 4,509,031 | 4/1985 | Sakata et al. | 355/251 |
| 4,557,582 | 12/1985 | Kan et al. | 355/251 |
| 4,558,294 | 12/1985 | Yamashita . | |
| 4,580,121 | 4/1986 | Ogawa . | |
| 4,608,737 | 9/1986 | Parks et al. . | |
| 4,638,281 | 1/1987 | Baermann . | |
| 4,806,971 | 2/1989 | Masham . | |
| 4,823,102 | 4/1989 | Cherian et al. . | |

*Primary Examiner*—Leo P. Picard
*Assistant Examiner*—Lincoln Donovan
*Attorney, Agent, or Firm*—Mark Z. Dudley

[57] ABSTRACT

An improved bar magnet and method of construction, and an improved magnetic core comprising an assembly of such magnets, for use in a processing station of an electrostatographic printing machine. The improved bar magnet is formed of permanent magnet material having magnetic domains therein that are magnetized along epicycloidal curve segments. The external magnetic flux density is improved over that of a conventionally-magnetized magnet. An injection mold for inducing the particular epicycloidal alignment of magnetic domains in the improved bar magnet is provided.

41 Claims, 5 Drawing Sheets

FIG. 1
PRIOR ART
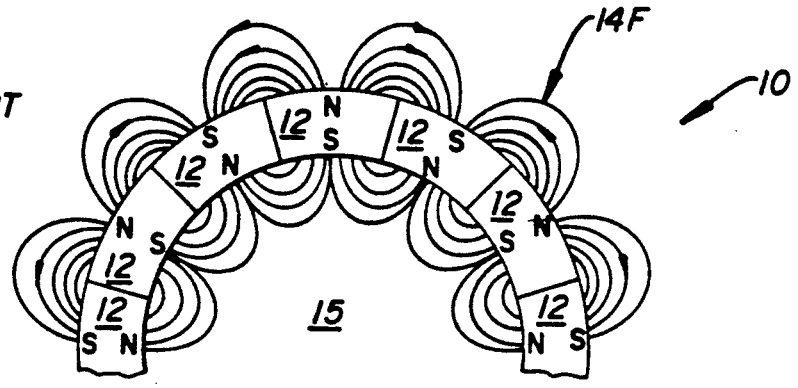
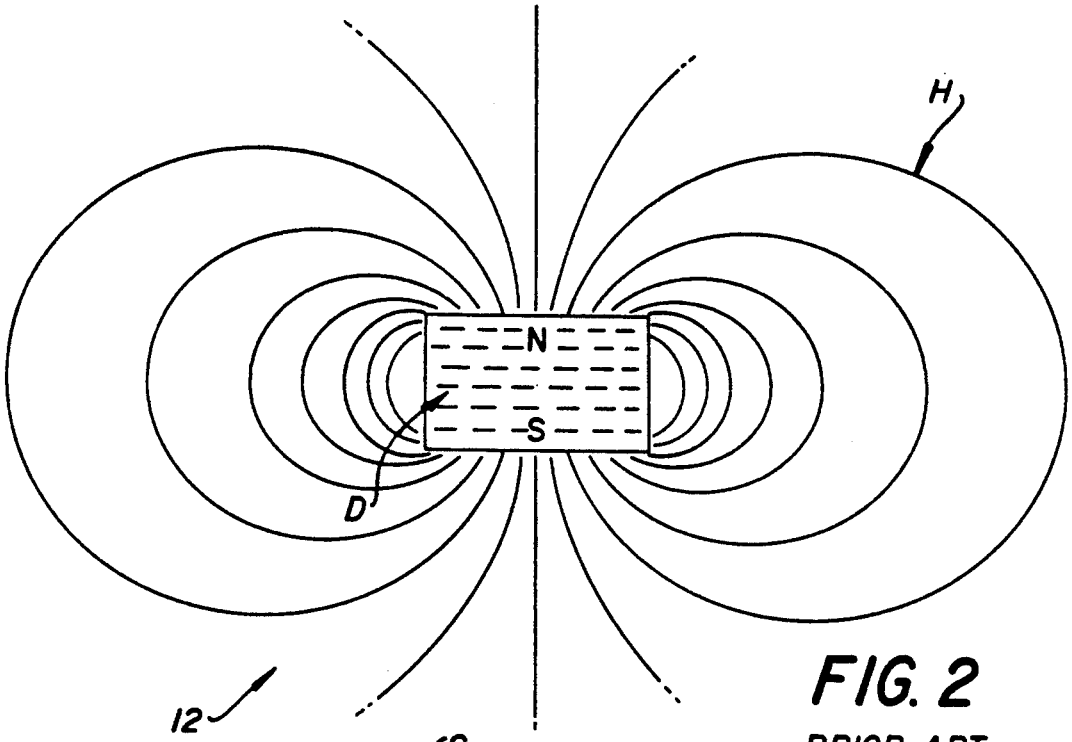
FIG. 2
PRIOR ART
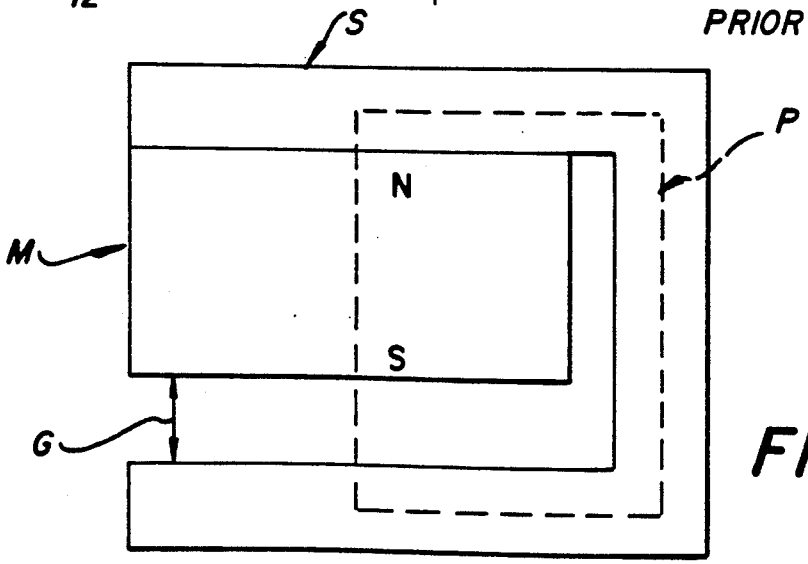
FIG. 3

FIG. 5
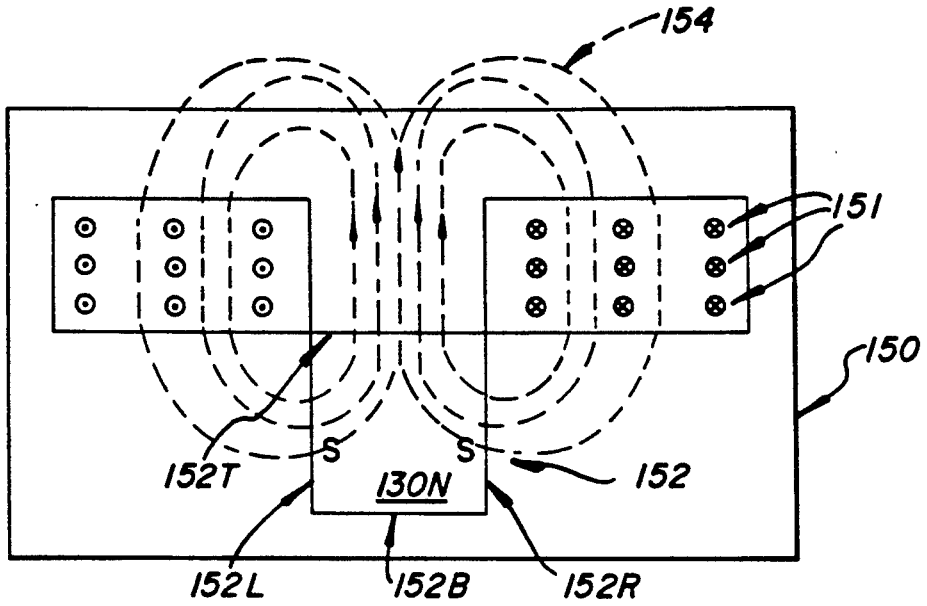
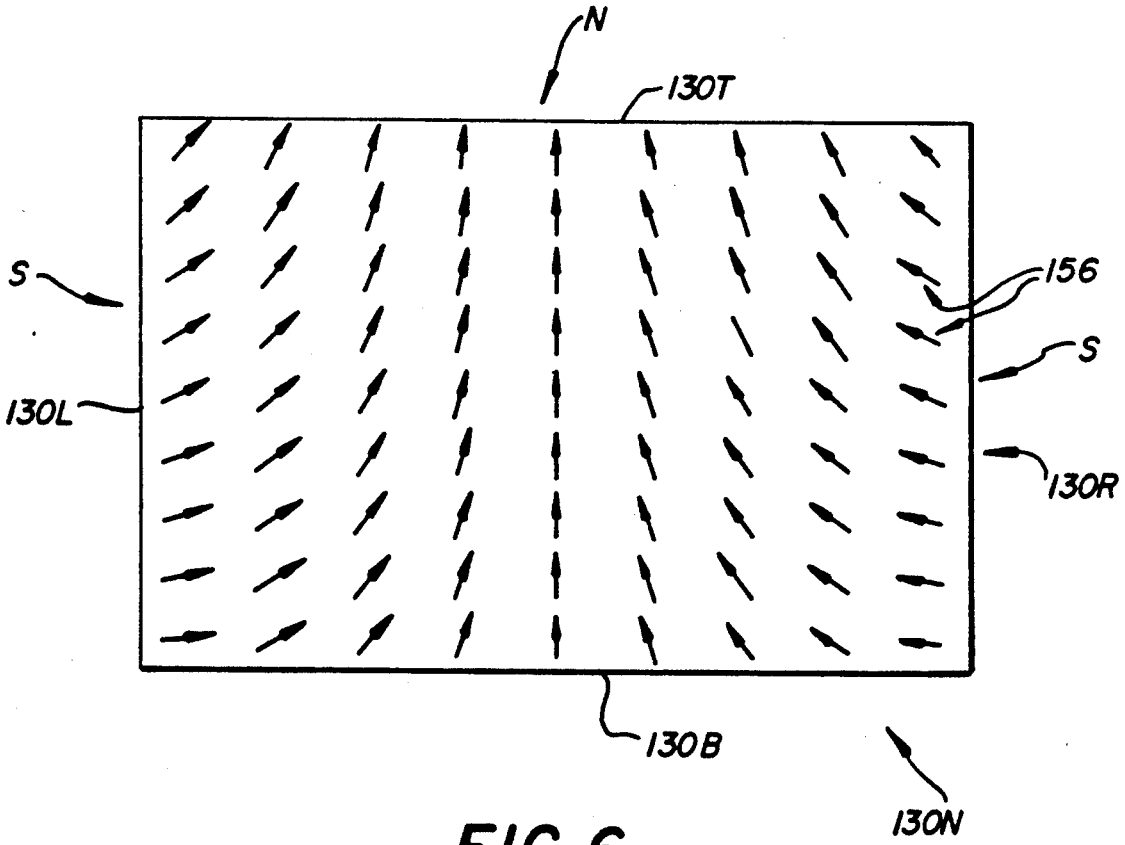
FIG. 6

FIG. 7
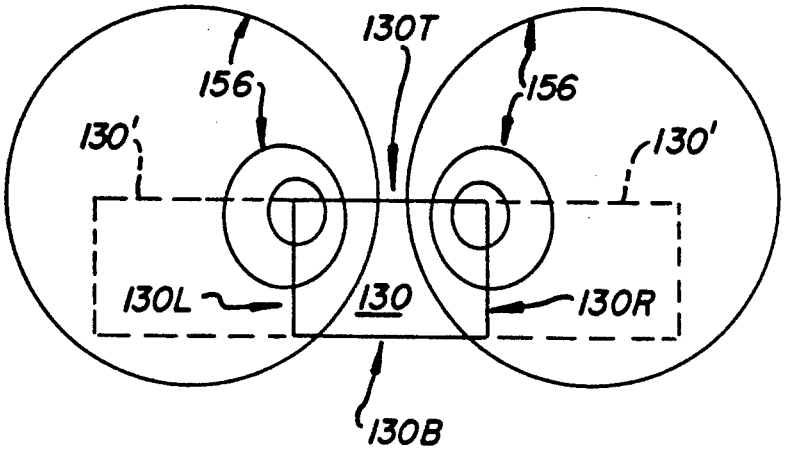
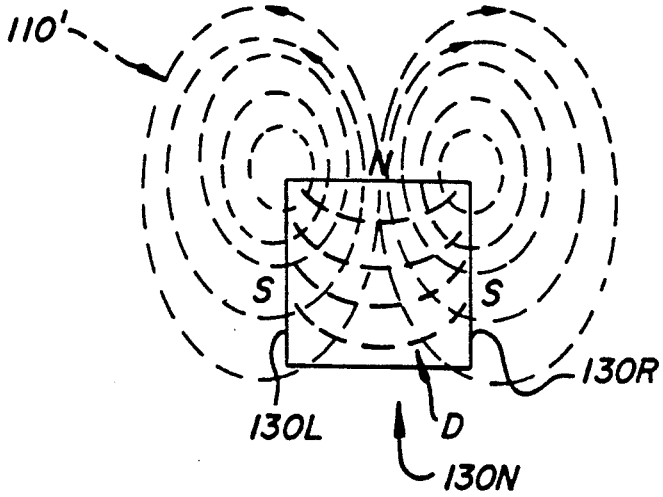
FIG. 8a
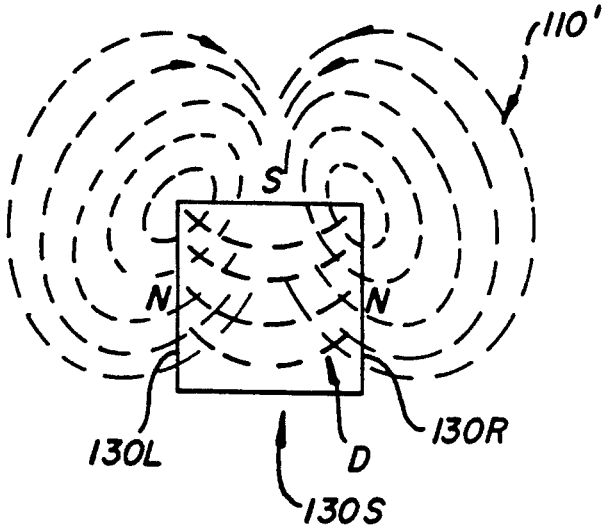
FIG. 8b

BAR MAGNET FOR CONSTRUCTION OF A MAGNETIC ROLLER CORE

FIELD OF THE INVENTION

This invention relates generally to magnetic roller systems for electrostatography, and more particularly to improvements in a bar magnet for use in a magnetic core.

BACKGROUND OF THE INVENTION

In the process of electrostatographic printing, a photoconductive member is uniformly charged and exposed to an image of an original document. Exposure of the photoconductive member provides an electrostatic latent image corresponding to the image of the original document. The latent image is developed by applying a developer material (developer) to the photoconductor over the area defined by the latent image frame. A typical two-component developer material is comprised of toner particles which adhere triboelectrically to carrier granules. The toner particles are attracted from the carrier granules to the latent image frame to form a developed image, which is subsequently transferred and fused to a copy sheet.

In electrostatographic copiers and printing machines, magnetic rollers are employed in some process stations, such as the developing station and the cleaning station, for transporting the developer. For example, in commonly-assigned U.S. Pat. No. 4,473,029, there is disclosed a development system comprising a magnetic brush roller and a two-component development material (developer). The magnetic brush applicator comprises a cylindrical sleeve having a cylindrically-shaped multi-pole magnetic core piece. The developer comprises a mixture of thermoplastic toner particles and hard magnetic carrier particles of high coercivity (>500 Oersted) and high remanence (>500 Gauss). Such materials are considered hard magnetic materials as opposed to pure iron, for example, which is a soft magnetic material. During rotation of the magnetic core piece, the developer is transported along the sleeve's outer surface from a reservoir to a development zone. The developer contacts the latent electrostatic image and toner particles are stripped from the carrier particles to effect image development. Following image development, these carrier particles are stripped from the sleeve and returned to the developer reservoir for toner replenishment.

At the cleaning station, a layer of carrier granules adheres to the sleeve of another magnetic roller for movement to the photoconductive member. Residual toner particles are attracted to the carrier granules for collection and removal (cleaning).

There are generally two types of magnetic cores: multiple-bar cores or single-piece cores. As illustrated in FIG. 1, a conventional multiple-bar core 10 is typically constructed from a group of permanent magnets 12 (each of which is typically bar-shaped) that are assembled upon a central support 15. The magnets 12 provide alternating, radially-oriented magnetic north N and south S pole faces. The magnetic field is therefore modeled as a circuit of magnetic flux lines 14F which originate from within the magnet 12, exit at a north pole face N, and return to the magnet by entering a south pole face S. Flux lines H from a given magnet generally pass through the adjoining magnets that are situated within the magnetic flux circuit. Each magnet has an appropriate pole face orientation so as to reinforce the magnetic flux 14F. A common choice of material to constitute the magnets 12 is a compacted (pressed) hard magnetic ferrite or other hard magnetic material, such as samarium cobalt.

Single-piece core construction is typically of a cylindrical body formed of powdered hard magnetic material compounded in a binder. For example, an injection-moldable compound of barium or strontium ferrite powder in a nylon binder is often used. Alternating magnetic poles N and S are formed in the body during the molding process, or shortly thereafter. A typical pole configuration may be twelve alternating poles situated at the external, or circumferential, surface of the core.

Examples of the above types of magnetic cores are present in the prior art. U.S. Pat. No. 4,806,971 discloses a single-piece core formed of a moldable plastic material containing a comminuted ferrite. Longitudinal, angularly-spaced poles are produced in the material during the molding process. U.S. Pat. No. 4,558,294 discloses a method for assembling a magnetic roll in which a plurality of plastic magnetic bars are bonded to a polygonal supporting base and each other. U.S. Pat. No. 4,580,121 describes a magnetic roll having an impeller-shaped support and a plurality of rubber matrix magnetic bars mounted on the support at desired locations. U.S. Pat. No. 4,608,737 discloses a magnetic developer roll made from rectilinear ribs of plastic magnets. U.S. Pat. No. 4,638,281 discloses a magnetic roll in which permanent magnetic bars are secured to a supporting base by an injection-moldable plastic. U.S. Pat. No. 4,823,102 discloses a magnetic roll having a central portion with a plurality of spaced radial fins; a magnet is secured in each space between the fins.

The magnetization of either core type (multiple bar or single piece core) is accomplished by the application of an intense, pulsed magnetic field. A simplified model of the magnetization of a conventional magnet 12 is illustrated in FIG. 2. Magnetic lines of force H generated by a magnetizing fixture (not shown) align the internal magnetic domains D of the crystalline structure in the body of the magnet 12. Each magnetic domain D may be modeled as a disk-like region having a magnetic dipole moment which aligns with the applied magnetizing field. After the magnetizing force H is removed, a proportion of the oriented domains are then magnetized according to the remanence of the material, to thus give the magnetized piece its permanent magnetic properties.

A single-piece core is typically magnetized in an electromagnetic fixture (not shown) having a plurality of electromagnet pole pieces with current-carrying windings thereon. The magnetizing pole pieces are arranged radially around the exterior of the mold to induce radial magnetizing field lines similar to the force lines H in FIG. 2. The magnetizing field thereby extends radially from the magnetizing pole pieces through the core.

Single-piece magnetic cores are economical only when produced in quantities greater than about 10,000 cores. The initial cost of production is very high because of the cost of the injection mold, the magnetizing fixture, and the pulsed power supply that energizes the magnetizing fixture. Because there is little space between the magnetizing pole pieces (in the magnetizing fixture), it is difficult to include adequately-sized induction coils on the pole pieces. The magnetizing field intensity induced at the desired point in the single-piece core is therefore limited by the number of wire turns on each coil, and the remnant external magnetic field strength of the core may be insufficient for some uses.

For a core quantity of less than about 10,000 units, a multiple-bar core assembled from bar magnets is usually more economical to produce than the single-piece core. Accordingly, prototype magnetic rollers are often built by assembling magnets 12 of pressed ferrite or ceramic magnetic material to form the core 10. Such ceramic or ferrite bar magnets are typically composed chiefly of hard magnetic material and little or no binder. Such a composition is usually selected because it is capable of a magnetic field strength that is higher than that available from a composition of a magnetic material bound with a non-magnetic binder.

The peak magnetic field strength at a predetermined distance from the conventional magnetic core 10 is typically available over the center of a magnetic pole. External field strength is a significant criterion in selecting a magnetic core for use in a magnetic roller. The deposition of carrier from a magnetic roller onto the photoconductor (known as developer pick-up or DPU) is quite undesirable and generally increases as the field strength decreases.

Permanent magnets formed from bound magnetic compounds offer less magnetic field strength because a certain volume of the formed piece is typically composed of non-magnetic binder. Ceramic bar magnets typically have little or no binder and thus have a higher field strength. The remanence ($B_r$) of a compound of a magnetic ferrite (e.g., barium ferrite) in a moldable binder is, for example, 2650 Gauss; the remanence of barium ferrite alone may be as high as 3800 Gauss. For convenience, the term "ceramic magnets" will be used herein to differentiate magnets of all or substantially all ceramic or ferrite magnetic material, from magnets formed of a magnetic material composition that includes one or more non-magnetic binders. Also, non-ceramic magnets are typically formed via methods such as injection molding or extrusion.

Ceramic magnets are not easily shaped for assembly into a cylindrical core. Ceramic bar magnets are typically formed from dry or wet ferrite powder (slurry) that is pressed into a form, magnetized, and then fired. The slurry undergoes considerable volumetric shrinkage during firing, and thus a fired piece typically requires costly machining to achieve specific dimensions. Hence, the slurry is often formed into slabs, fired, and then cut into rectilinear bars. Ceramic bar magnets may then lack the fan-shaped cross-section that is preferred for their assembly into a smoothly-continuous cylindrical core. Significant air gaps between the assembled bars must be tolerated, and the low permeability of each air gap lowers the level of the magnetic field intensity that can be produced by such a core. Because ceramic magnets are quite hard and brittle, their exposed edges are prone to cracking and chipping.

Ceramic magnets can be cost-effective when assembled as a prototype but they are too expensive to use in a high-quantity production run of cores. On a per-unit basis, the production cost of a machined ceramic bar is approximately ten times the production cost of an equivalently-shaped injection-molded bar magnet.

However, the use of non-ceramic (injection-molded, for example) magnets in a magnetic core has been limited because the external field strength of such a core is insufficient to control DPU in some applications. Similarly, the use of injection-moldable compounds in single-piece cores has been limited. Therefore, a magnetic core is often composed of ceramic bar magnets rather than of bar magnets composed of magnetic material in a binder.

SUMMARY OF THE INVENTION

It is an object of the present invention to provide an improved magnet for use in a magnetic core. Another object is to provide an improved multiple-bar magnetic core.

These and other objects are accomplished by a magnet for a magnetic core which is formed of a body of hard magnetic material having magnetic domains therein. The body includes a first magnetic pole face and second and third generally opposing magnetic pole faces. The first pole face is of a first polarity and located generally transverse to the second and third pole faces, and the second and third pole faces are of a polarity opposite to that of the first pole face. The magnetic domains are aligned along generally diverging curved paths between the first pole face and the second and third pole faces.

According to a preferred embodiment, a first plurality of the magnetic domains in the magnet are generally aligned according to a first epicycloidal curve segment between the first magnetic pole face and the second magnetic pole face. A second plurality of the domains is aligned according to a second complementary epicycloidal curve segment between the first magnetic pole face and the third magnetic pole face.

A bar magnet with its domains so aligned exhibits a substantially greater external field than prior comparable magnets with domains aligned in only one direction through the magnet.

According to a further preferred embodiment, the magnets in the above embodiments may be formed from an injection-moldable hard magnetic material. Such magnets exhibit a magnetic field strength that is comparable to, or greater than, the field strength of a ceramic bar magnet having similar dimensions. The injection-molded magnet is lightweight, inexpensive, and easy to mold or machine to a desired shape. It is thus usable in several applications, that is, in the prototyping and production of magnetic cores.

According to another aspect of the invention, a magnetic core is provided for use in a magnetic roller. The core includes a plurality of magnets constructed according to the invention.

According to a preferred embodiment, each magnet is positioned on a support between at least two adjoining magnets with the first pole faces of the magnets positioned circumferentially with alternating polarity. The second and third pole faces of each magnet are oriented to like faces of opposite polarity in the adjoining magnets.

The magnetic core is assembled from the aforementioned magnets and accordingly benefits from their advantages. Thus, the core is easily assembled, is light in weight, has a smooth cylindrical surface, and may be formed from a compound of hard magnetic material in a binder without compromising magnetic field strength.

A method is provided of producing a magnet for a magnetic core wherein a body is formed of hard magnetic material which has magnetic domains therein. The body has a first surface and second and third generally opposing surfaces. The first surface is located generally transverse to the second and third surfaces. A magnetizing means is positioned, with respect to the first, second, and third surfaces, for inducing magnetizing field lines along generally diverging curved paths between the first surface and the second and third surfaces. The magnetizing means is activated to magnetize the domains along the paths and to induce first, second, and third remanent magnetic pole faces respectively at the first, second, and third surfaces. The polarity of the first pole face is made the opposite of the second and third pole face polarities.

BRIEF DESCRIPTION OF THE DRAWINGS

The subsequent description of the preferred embodiment of the present invention refers to the attached drawings wherein:

FIG. 1 is a schematic side sectional view of a conventional magnetic core exemplary of the type adapted for use in a development or cleaning station of an electrostatographic copier or printer;

FIG. 2 is a schematic side view of a conventional bar magnet and a representation of the magnetic domains therein, used in the core of FIG. 1;

FIG. 3 is a schematic side sectional view of a simple magnetic circuit of a permanent bar magnet;

FIG. 5 is a side sectional view of a magnetizing injection mold used in the production of one version of the improved bar magnets of FIG. 4B;

FIG. 6 is a schematic representation of the internal magnetization alignment in the improved bar magnet of FIG. 4B;

FIG. 7 is a schematic representation similar to that of FIG. 6 and representing the magnetic flux lines of the improved bar magnetic;

FIGS. 8*a* and 8*b* are side sectional views of the full-strength north pole and full-strength south pole versions of the improved bar magnet, with schematic illustration of the magnetic flux and magnetic domain orientations therein.

BEST MODE OF CARRYING OUT THE INVENTION

Figure 4A:
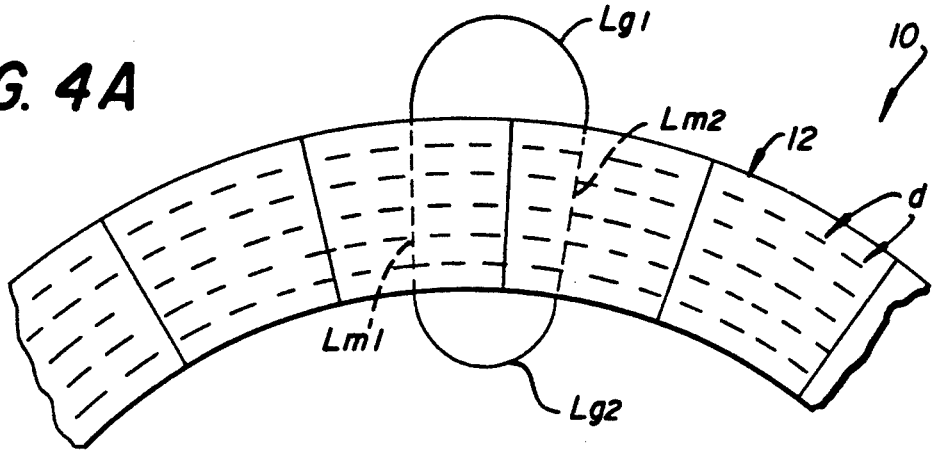
FIG. 4A is a schematic side sectional view of the magnetic core of FIG. 1 showing a simplified representation of a magnetic flux circuit therein.

Because electrostatographic reproduction apparatus are well known, the present description will be directed in particular to elements forming part of, or cooperating more directly with, the present invention. Apparatus not specifically shown or described herein are selectable from those known in the prior art. For a general understanding of the features of the present invention, reference is made to the drawings. In the drawings, like reference numerals have been used throughout to designate identical elements.

The present invention is derived from experimentation designed to improve the production of multi-pole magnetic cores by injection molding. Improvements to an injection-molded bar magnet and a multiple-bar core made of same, and methods for their production, are now provided in the following description of the present invention.

The invention will be better appreciated after a simplified description of the generalized magnetic circuit for a permanent magnet. As shown in FIG. 3, a simple magnetic circuit path P may be described for a permanent bar magnet M having magnetic poles N and S. The circuit path originates in the magnet M and circulates through a gap G and mild steel flux return path S. The calculation of the magnetic flux density in the gap G may be simplified by assuming that there is no flux leakage from the magnetic circuit and that the recoil permeability of the magnet M is unity. This is approximately true for most modern high-strength magnetic materials such as barium ferrite, samarium-cobalt, neodymium-iron-boron, and others. The magnetic flux density in the gap G is therefore given by:

$$Bg = \frac{Lm}{Lm + Lg}(Br) \tag{1}$$

where

Bg = magnetic flux density in gap, in Gauss

Br = remanent magnetization for the magnetic material, in Gauss

Lm = length of the magnet

Lg = length of the magnetic gap (Further information on the derivation of the above may be found in Parker, R. J., and Studders, R. J., *Permanent Magnets and Applications*, John Wiley, 1962.)

As was shown in FIG. 1, a conventional magnetic core 10 has a given magnetization, which is typically according to a radial alignment of the magnetic domains D in each constituent magnet 12. With reference now to FIG. 4A, Lm and Lg in the magnetic circuit of such a magnet 12 may be considered as:

$$Lm = Lm_1 + Lm_2 \tag{2}$$

and $$Lg = Lg_1 + Lg_2 \tag{3}$$

Equations (2) and (3), when considered in light of Equation (1), indicate that the external magnetic field near the surface of the magnet 12 is roughly proportional to the right side of Equation (1).

Figure 4B:
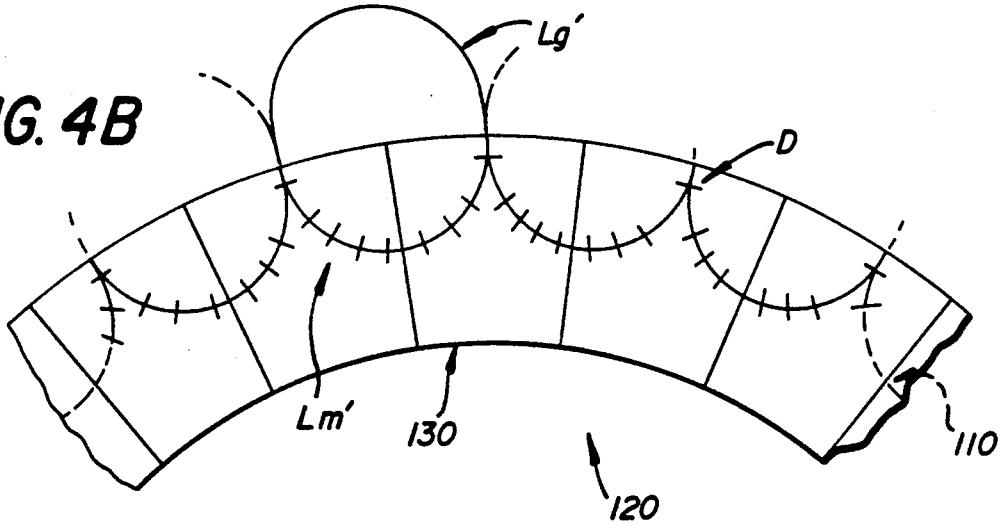
FIG. 4B is a schematic side sectional view of an improved magnetic core having improved bar magnets that exhibit a novel orientation of magnetic domains according to the the present invention.
Figure 4C:
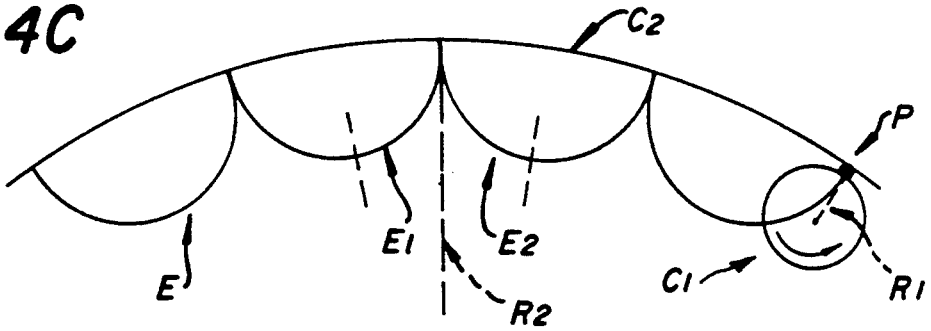
FIG. 4C is a diagrammatic representation of a epicycloidal curve pertinent to the practice of the present invention.

Now with reference to FIG. 4B, and according to the present invention, magnetic flux may be more efficiently provided in an improved magnetic core 120 by use of improved bar magnets 130. More specifically, such magnetic flux is provided according to epicycloidal flux lines 110 exhibited by the improved bar magnets 130. For the purposes of this disclosure, a simple epicycloidal curve is illustrated in FIG. 4C. An epicycloidal curve E is traced by a point P on a circle $C_1$ of given radius $r_1$ which rotates within a circle $C_2$ having a larger radius $r_2$. The curve E may be seen as having curve segments $E_1$ and $E_2$ which generally diverge from an appropriately-located radius $r_2$.

One portion of magnetic flux lines 110 flows between a given radial surface of each magnet 130 to the outer, or circumferential surface of the magnet. A complementary portion of the flux lines 110 flows between the opposing radial surface to the circumferential surface. The flux lines 110 result from the epicycloidal magnetization of the magnetic domains D in directions generally parallel to one of two diverging curve segments. As may be seen in comparison to FIG. 2, the alignment of the magnetic domains D of the improved bar magnet 130 differs substantially from the conventional radial alignment of domains D in the prior art magnet 12.

The flux lines 110 circulate in magnetic paths which may be considered as being comprised of Lm' and Lg'. The epicycloidal magnetization is significant, therefore, in that Lm' is larger than Lm, and Lg' is less than Lg (i.e., less than the sum of $Lg_1+Lg_2$).

Hence, with reference again to Equation (1), the magnetic flux density in the gap $B_g$ of the magnetic circuit of the improved bar magnet 130 is a larger proportion of that magnet's remanent magnetization $B_r$. This causes the flux density near the surface of the improved bar magnet 130 to be greater than that afforded by the conventionally-magnetized bar magnet 12.

The present invention thus provides an improved bar magnet 130 having a magnetization that more efficiently establishes a magnetic field strength at a given point from its working (circumferential) surface. As may be appreciated from out above calculations, the usable magnetic field energy of such an improved bar magnet 130 is maximized by magnetizing its magnetic domains along diverging curved paths so as to decrease Lg and increase Lm.

Analysis of the remanent external field strength of the improved magnetic core 120 has indicated that the magnetic performance of such a core is significantly higher than that of a conventionally-magnetized core. In practice, up to a 30% improvement in useable magnetic field strength has been achieved using this type of magnetic domain orientation.

With reference now to FIG. 5, the construction of the improved bar magnet 130 will be described. The improved bar magnet 130 is preferably produced using injection molding to provide a bar of selected dimensions and magnetic polarity. Of course, other known magnet-forming methods and technologies are useable, such as the forming of a magnetic material by extrusion or pressed-powder construction. Injection molding of magnets is well-known in the art, and therefore the following will describe the inventive departures from the conventional molding process. Apparatus and methods not described or illustrated are nonetheless assumed to be provided as are known in the art.

The preferred embodiment of a mold 150 suitable for the production of one embodiment 130N of the improved bar magnet 130 is shown in FIG. 5. The mold cavity 152 is filled with filler of a hard magnetic material. Preferably, the filler is a mixture of a hard magnetic material in a moldable binder, such as a compound of a powdered, highly-coercive ferrite material in a polymeric (thermoplastic) binder. One example of such compound includes a magnetic oxide such as barium ferrite (e.g., $BaO.6Fe_2O_3$ or $BaFe_{12}O_{19}$). A commercially-available example of a barium ferrite compound is known as 3M B-1061 and is available from the Electronic Products Division of the 3M Company, in St. Paul, Minn. Another preferred compound is a strontium ferrite compound known as FMG4118W and is available from the Sumitomo Bakelite Co. Ltd., of Tokyo, Japan. The remanence or residual induction ($B_r$), intrinsic coercive force ($H_{ci}$), and energy product ($B\text{-}H_{max}$) of these examples are listed below:

| Compound | Magnetic Material | $B_r$ | $H_{ci}$ | $B\text{-}H_{max}$ |
|---|---|---|---|---|
| B-1061 | barium ferrite | 2650 G | 3000 oe | 1.8 MGO |
| FMG4118W | strontium ferrite | 2900 G | 3050 oe | 2.0 MGO |

However, it will be appreciated that any permanent magnetic material may be magnetized to achieve the particular epicycloidal alignment in the flux pattern segment 110' according to the teachings of the present invention. Such compounds include very high-coercivity materials such as cobalt-rare earth alloys and neodymium iron boron (Ne-Fe-B); however, the 3M and Sumitomo compounds listed are preferred for their good magnetic performance at a low material cost.

Hence, it is contemplated that those skilled in the art may choose to substitute a substantially ceramic magnetic material (having no binder, e.g., a pressed block) for the filler in the cavity 152. With slight modifications, the mold 150 could receive the block for magnetization using the magnetizing field 154. In doing so, an improved bar magnet 130 of ceramic composition having very high remanent magnetization should be achieved. However, the magnet of ceramic material would not be as easy to handle and machine as would be the preferred embodiment of the improved bar magnet 130N, which is bound by a polymeric binder material. The ceramic version of the improved bar magnet would also be susceptible to the other disadvantages of ceramic bars that are discussed in the Background of the Invention.

The filler of preferred injection-moldable compound is injected under pressure according to known molding processes to thereby fill the cavity 152. In the illustrated embodiment, the mold cavity 152 is shown as being rectilinear in cross-section; however, other cross-sections may be used. In another preferred embodiment (not shown), the cavity 152 cross-section is wider at its top than at the bottom, i.e., fan-shaped, to facilitate the assembly of the molded bar magnet into a cylindrical core. (Further description of such a shape will be provided with respect to FIG. 9.)

The mold 150 includes an induction coil 151 which is situated above the mold cavity 152 and is energized during molding so as to induce the desired epicycloidal field 154 in the filler. For clarity, the coil 151 is shown as being energized with a current to orient the domains D of the filler along two diverging curve segments. One segment extends between a half-strength south pole face S at the left side 152L of the cavity 152 to a substantially full-strength north pole face N at the top side 152T of the mold cavity 152. A complementary segment extends between the same full-strength pole face N to a half-strength pole face S at the right side 152R. However, it will be appreciated that a reversal of the coil current will effect a reversal of the aforementioned pole face polarities. The coil 151 is positioned above the mold cavity so as to provide, along with predetermined control of the intensity of the induced field, the novel epicycloidal field pattern in a direction and amplitude sufficient to provide magnetization of the oriented domains. In using the preferred injection-moldable compounds, such an intensity is reached at about 10,000 Gauss.

In the preferred embodiment 130N, the half-strength pole faces S are generally equivalent in strength and combine in magnitude to equal or nearly equal the field strength of the respective full-strength pole face. It is contemplated that in some applications, the domains D will be magnetized to provide two half-strength pole faces of various non-equivalent strengths, such as 60% and 40%, or 35% and 35%, respectively, of the full-strength pole face. The location of peak field strength above the full-strength pole face may thereby be shifted. However, for purposes of description, the half-strength pole faces will be so denoted, with the understanding that their strengths may be of other proportions in other inventive embodiments.

After the mold is cooled and the induced field 154 is removed, a remanent magnetic flux pattern is realized inside the magnetized and molded filler, which now forms the improved bar magnet 130N. FIG. 6 shows an enlarged view of the remanent magnetic flux 156 within the improved bar magnet 130N. A full-strength magnetic pole face N is formed at the top side 130T of the magnet, and two half-strength pole faces S at the opposing lateral surfaces 130L and 130R. The magnetic flux vectors 156 enter the surfaces 130L and 130R and exit at the top surface 130T of the bar 130N. (Because the bar magnet 130 is intended for assembly into a cylinder, the top surface 130T may be denoted the circumferential surface, and the lateral surfaces 130L and 130R may be denoted as opposing radial surfaces. However, the magnet structure is unchanged.) As may be appreciated from the illustration, the distribution of magnetic flux indicates that little flux 156 passes through the bottom surface 130B of the bar 130N.

Another embodiment of the improved bar magnet 130 is also produced according to the teachings of the present invention, wherein the vectors 156 and the pole faces N and S of the magnet 130N have their polarity reversed. The bar domains D are oriented and magnetized by a current of reversed polarity in the induction coil 151. This alternative embodiment is designated as bar magnet 130S and will be discussed further with respect to FIG. 8.

FIG. 7 shows an enlarged representation of the remanent magnetic flux 156 exhibited by the improved bar magnet 130. (So as to illustrate both versions of 130N or 130S, the flux vector direction is not shown but should be assumed as being of appropriate polarity.) Additional bar magnets 130' are assumed to be positioned adjacent to the bar magnet 130, but only the magnetic flux generated by the bar magnet 130 is shown. The majority of magnetic flux 156 passes through the radial surfaces 130L and 130R and the top 130T of the bar magnet 130. Most magnetic flux lines 156 thereby traverse only one air gap (when exiting the full-strength pole face), whereas the conventional radial flux 14F of FIG. 1 must pass through two air gaps to make a complete circuit.

The improved bar magnet 130N or 130S made according to the present invention may be characterized as a "T-bar magnet", in that an inverted "T" shape describes the pole face locations. Normals drawn inwardly from the circumferential surface and the radial surface describe an inverted "T". The vertical portion of the "T" points to the full-strength pole face of the magnet. The two ends of the "T" horizontal portion point to the two respective half-strength pole faces. It is contemplated that the full-strength pole face is located roughly orthogonally with either of the half strength pole faces. However, this "T" relation is meant to be descriptive but not limiting, and can be altered to an extent (such as to an inverted "Y" relation) without departing from the teachings of this invention.

As shown in FIG. 8, the improved bar magnet 130 is produced in a first version 130N having a full-strength north pole face N or in a second version 130S having a full-strength south pole face. With comparison of FIG. 8 to reference to FIG. 2, it will be appreciated that several features distinguish the improved bar magnets 130N or 130S from the conventional bar magnet 12 produced according to the prior art. In the conventional bar magnet 12, the north N and south S pole faces are on opposite, vertically-opposed surfaces of the magnet 12, and they are of equal strength. The magnetic domains D are all roughly parallel, and the majority of the magnetic flux passes radially through the top and bottom surfaces of the magnet 12. In the improved bar magnet 130, there are two half-strength pole faces for every full strength pole face. The magnetic domains D are not parallel, but instead are epicycloidally oriented to cause the majority of the magnetic flux to pass through the top surface 130T and the two radial surfaces 130L and 130R, while very little magnetic flux passes through the bottom surface 130B. The external magnetic field strength at a selectable point above the full-strength pole face is thereby greater than the field strength at a similar point above a conventional, radially-aligned magnet.

To compare the performance of an improved injection-molded magnet 130 to other bar magnets having identical dimensions but differing compositions and magnetizations, the peak magnetic flux density B was measured at 0.010 inch above the working face of several magnets. For comparison, the flux density of an improved magnet 130 composed of 3M B-1061 compound ($B_r$=2650 G.) was found to be 1000 Gauss. In an improved bar magnet 130 composed of Sumitomo FMG4118W compound, the measured magnetic flux density was 1300 Gauss, which significantly exceeded the flux density measured above a ceramic bar magnet of radial magnetization. These results are tabulated below:

| Magnetization | Compound | $B_r$ (G.) | Flux Density (G.) |
|---|---|---|---|
| radial | 3M B-1061 | 2650 | 776 |
| radial | ceramic | 3400 | 990 |
| T-Bar | 3M B-1061 | 2650 | 1000 |
| T-Bar | FMG4118W | 2900 | 1300 |

Figure 9:
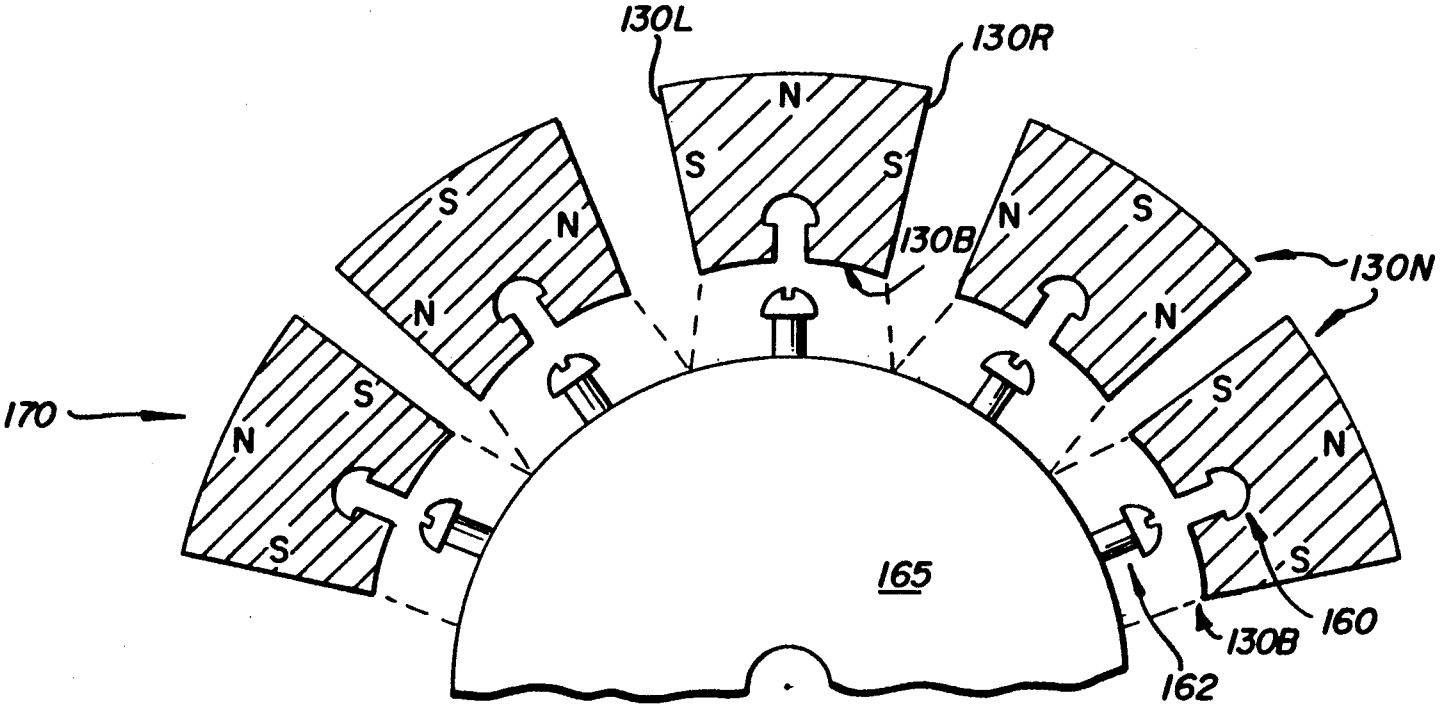
FIG. 9 is a side sectional view of an exploded half of a magnetic core assembled using the improved bar magnets according to the present invention.

As illustrated in FIG. 9, an improved, high-performance magnetic core 170 may be constructed by assembling a complement of close-fitting fan-shaped improved bar magnets 130N and 130S. (Only the upper portion of the core assembly is shown; the remainder is symmetrical with the upper portion and thus has been omitted for clarity.) The preferred cross-section of the bar magnets 130N and 130S is a fan-shape or similar profile that allows several magnets to be closely fitted into a smooth cylindrical core. This cross-section may be provided by machining or by molding the magnet in the desired shape. In the preferred embodiment, the circumferential surfaces of the bar magnets 130N and 130S form the exterior of the magnetic core 170. The improved bar magnet may be attached with adhesive at its radial surfaces 130L and 130R to the complementary surfaces of adjoining magnets and at its bottom surface 130B to a support 165. In a particularly preferred embodiment, each magnet is retained on the support 165 by a set of longitudinally-spaced apertures 160 that are molded or machined in the lower surface 130B of the magnet. Each aperture 160 receives a complementary prong 162 which extends from the support 165. The core 170 is then assembled by snapping a magnet 130 onto each prong 162 without the use of adhesive.

An improved twelve-pole magnetic core of injection-molded barium ferrite T-bar magnets 130, similar to the illustrated core 170, provided a measured flux density of 834 Gauss at a point 0.050 inches (1.25 millimeters) above the core surface. The measured flux density of a similarly-shaped conventional core (having a radially-oriented field provided by rectilinear ceramic-8 bar magnets) was 899 Gauss. A ten-pole version of the improved core 170, assembled from injection-molded barium ferrite T-bars, produced approximately 1300 Gauss. A similarly-sized core of radially-magnetized bars of barium ferrite compound produced a peak flux density of approximately 1175 Gauss. The improved cores 170 were therefore quite suitable for use in a magnetic roller.

In summary, an improved bar magnet 130 constructed according to the present invention provides improved external magnetic field and magnetic flux density in comparison to that provided by a conventional, radially-aligned bar magnet of similar composition. It is significant, therefore, that with proper selection of a magnetic material, an improved bar magnet may be injection-molded according to the invention, and yet will offer a higher flux density than is provided by a similarly-sized, conventionally-magnetized ceramic bar magnet. These improvements are due to a novel epicycloidal orientation and magnetization of magnetic domains in the improved bar magnet, which is achieved by an applied epicycloidal magnetizing field. The injection-molded improved bar magnet is thus less costly and more versatile than the conventional, radially-aligned ceramic bar magnet.

The economy of the injection-molded improved bar magnet may be increased if a sufficiently high number of bars are produced for use in both prototyping and production of magnetic rollers. Because the injection-molded magnet is so easily cut and machined, cores in a range of sizes can then be made from one simple set of bars. These injection-molded magnets are then especially desirable for use in the prototyping of magnetic rollers.

For a production run of a large number of magnets, the injection-molded improved bar magnet can also be formed in any desired shape, such as the preferred fan-shape cross section. The magnet can be designed to include structural features, such as support tabs, holes, channels, and the like. A plurality of such magnets can thus be easily assembled into a core immediately after the molding process is finished. Alternatively, a standard oversize bar may be molded and then machined to a fit a predetermined radius for assembly into a cylinder of selected diameter and number of poles.

Because the improved bar magnet 130 may be formed in a fan-shape, they are easily assembled into a smooth, gap-free improved magnetic core of selectable size and increased performance. The improved magnetic core is accordingly competitive in performance with multiple bar cores formed from materials of higher remanence, such as ceramic bar magnets.

The improved magnetic core 170 also achieves a higher field strength than a single-piece magnetic core made according to a conventional magnetization process. In the magnetizing fixture for producing the improved bar magnet 130, there is room for a greater number of wire turns in the induction coil than is typically available for the same in a fixture for magnetizing a single-piece magnetic core. Consequently, a more intense and better-focussed magnetizing field is induced in the injection-molded improved bar magnet 130 than may be induced in a comparable portion of an injection-molded single-piece core. The remanent field of an improved multiple-bar core 170 is therefore greater than a conventionally-magnetized single-piece core of similar size and composition.

Further, the methods described herein are contemplated as being useful to produce improved multiple bar cores of relatively small sizes. For example, some very small but highly-magnetized improved bar magnets 130 have been made for assembly into magnetic cores having diameters of, for example, 0.60 inches (approx. 15 millimeters). Such cores have been useful in toner carrier scavenging (scavenger) magnetic rollers.

The invention has been described in detail with particular reference to preferred embodiments thereof, but it will be understood that variations and modifications can be effected within the spirit and scope of the invention.

What is claimed is:

1. A magnet for a magnetic core, the magnet comprising:

a body of hard magnetic material having magnetic domains therein; and a first magnetic pole face and second and third generally mutually opposing magnetic pole faces, the first pole face being of a first polarity and located generally transverse to said second and third pole faces, the second and third pole faces being of a polarity opposite to that of the first pole face, and the domains being aligned along generally diverging curved paths between the first pole face and the second and third pole faces.

2. The magnet of claim 1, wherein a first plurality of the magnetic domains are generally aligned according to a first epicycloidal curve segment between the first magnetic pole face and the second magnetic pole face, and a second plurality of the domains is aligned according to a second complementary epicycloidal curve segment between the first magnetic pole face and the third magnetic pole face.

3. The magnet of claim 2, wherein the first and second pluralities of domains provide respectively a first portion of external magnetic flux which flows between the first magnetic pole face and the second magnetic pole face and a second portion of external magnetic flux which flows between the first magnetic pole face and the third magnetic pole face.

4. The magnet of claim 1, wherein the external magnetic field strengths of the second and third pole faces combined is greater than $0.7\times$the external magnetic field strength of the first pole face.

5. The magnet of claim 1, wherein the first, second, and third pole faces are located in respective planes having normals which, when drawn inwardly, define an inverted "T".

6. The magnet of claim 1, wherein the hard magnetic material further comprises a binder.

7. The magnet of claim 6, wherein the body of the magnet is elongated and the cross-section of the body is fan-shaped.

8. A magnet for a magnetic core, the magnet comprising:

a body of hard magnetic material having opposing first and fourth surfaces and mutually opposing second and third surfaces;

the hard magnetic material having magnetic domains aligned to create a magnetic pole face of a first polarity associated with the first surface and pole faces of an opposite polarity associated with the second and third surfaces; and the domains being aligned along generally diverging curved paths between the first pole face and the second and third pole faces.

9. The magnet of claim 8, wherein the external magnetic field strengths of the second and third pole faces combined is greater than 0.7×the external magnetic field strength of the first pole face.

10. The magnet of claim 9, wherein the external magnetic field strengths at the second and third pole faces are substantially equivalent.

11. The magnet of claim 8, wherein the first, second, and third pole faces are located in respective planes having normals which, when drawn inwardly from the first, second, and third pole faces, define an inverted "T".

12. The magnet of claim 8, wherein the hard magnetic material further comprises a binder.

13. The magnet of claim 8, wherein the body is elongated and the body cross-section is fan-shaped.

14. The magnet of claim 8, wherein a first plurality of the magnetic domains are generally aligned according to a first epicycloidal curve segment between the first magnetic pole face and the second magnetic pole face, and a second plurality of the domains is aligned according to a second complementary epicycloidal curve segment between the first magnetic pole face and the third magnetic pole face.

15. The magnet of claim 8, wherein the first and second pluralities of domains provide respectively a first portion of external magnetic flux which flows between the first magnetic pole face and the second magnetic pole face and a second portion of external magnetic flux which flows between the first magnetic pole face and the third magnetic pole face.

16. A magnet for a magnetic core, the magnet comprising:

a body of hard magnetic material having magnetic domains therein, and first, second, and third magnetic pole faces, the first pole face being located adjacent to and contiguous with the second and third pole faces; and the second and third pole faces having a polarity that is the opposite of the first pole face and the domains being aligned along generally diverging curved paths between the first pole face and the second and third pole faces;

wherein the effect of the location of the second and third pole faces is an increase in the external magnetic field strength at the first pole face.

17. The magnet of claim 16, wherein the first, second, and third pole faces are located in respective planes having normals which, when drawn inwardly from the first, second, and third pole faces, define an inverted "T".

18. The magnet of claim 16, wherein the hard magnetic material further comprises a compound of a magnetic oxide in a binder.

19. The magnet of claim 18, wherein the magnetic oxide further comprises a barium ferrite material.

20. The magnet of claim 16, wherein the body is elongated and the body cross-section is fan-shaped.

21. The magnet of claim 16, wherein the external magnetic field strengths of the second and third pole faces combined is greater than 0.7×the external magnetic field strength of the first pole face.

22. The magnet of claim 21, wherein the magnetic field strengths at the second and third pole faces are substantially equivalent.

23. The magnet of claim 16, wherein a first plurality of the magnetic domains is aligned according to an epicycloidal curve segment between the first magnetic pole face and the second magnetic pole face, and a second plurality of the domains is aligned according to a complementary epicycloidal curve segment between the first magnetic pole face and the third magnetic pole face.

24. The magnet of claim 23, wherein the alignments of the first and second pluralities of domains provide respectively a first portion of external magnetic flux which flows between the first magnetic pole face and the second magnetic pole face and a second portion of external magnetic flux which flows between the first magnetic pole face and the third magnetic pole face.

25. A magnetic core for use in a magnetic roller, comprising:

a support; and a plurality of magnets mounted peripherally around the support, each magnet having a body of hard magnetic material having magnetic domains therein, and a first magnetic pole face and second and third generally mutually opposing magnetic pole faces, the first pole face being of a first polarity and located generally transverse to said second and third pole faces, the second and third pole faces being of a polarity opposite to that of the first pole face, and the domains being aligned along generally diverging curved paths between the first pole face and the second and third pole faces;

wherein each magnet is positioned on the support between at least two adjoining magnets, the first pole faces of the magnets being circumferentially positioned with alternating polarity, and the second and third pole faces of each magnet being oriented to like faces of opposite polarity in the adjoining magnets.

26. The magnetic core of claim 25, wherein a first portion of the magnetic domains is generally aligned along an epicycloidal curve segment between the first and second magnetic pole faces and a second portion of the domains is generally aligned along a complementary epicycloidal curve segment between the first and third magnetic pole faces.

27. The magnetic core of claim 25, wherein the sum of the external magnetic field strengths of the second and third pole faces is greater than 0.7×the external magnetic field strength of the first pole face.

28. The magnetic core of claim 25, wherein the first, second, and third pole faces are located in respective planes having normals which, when drawn inwardly from the first, second, and third pole faces, define an inverted "T".

29. The magnetic core of claim 25, wherein the hard magnetic material in at least one magnet further comprises a compound of a magnetic oxide in a binder.

30. The magnetic core of claim 29, wherein the magnetic oxide further comprises a barium ferrite material.

31. The magnetic core of claim 29, wherein the body is elongated and the body cross-section is fan-shaped.

32. A method of producing a magnet for a magnetic core, comprising the steps of:

forming a body of hard magnetic material having having magnetic domains therein and having a first surface and second and third generally mutually opposing surfaces, the first surface being located generally transverse to the second and third surfaces;

positioning, with respect to the first, second, and third surfaces, magnetizing means operable for inducing magnetizing field lines along generally diverging curved paths between the first surface and the second and third surfaces; and activating the magnetizing means to magnetize the domains along the paths and to induce first, second, and third remanent magnetic pole faces respectively at the first, second, and third surfaces, the first pole face being of a first polarity and the second and third pole faces being of a polarity opposite to that of the first pole face.

33. The method of claim 32, further comprising the steps of:

positioning an induction coil at a position spaced from the first surface for inducing the magnetizing field lines along paths which pass through the first surface and diverge to enter or exit the second and third surfaces.

34. The method of claim 32, further comprising the steps of:

compounding a hard magnetic material with a binder to provide a filler;

providing a mold cavity having a first side and second and third generally opposing sides, the first side being located generally transverse to the second and third sides, for forming respectively the first, second and third surfaces;

injecting the filler into the mold cavity in a fashion sufficient to form the body; and positioning an induction coil at a position spaced from the cavity first side for inducing the magnetizing field lines along paths which pass through the first side and diverge to enter or exit the second and third sides;

hardening the formed body into at least a semi-rigid state to provide a magnet.

35. The method of claim 34, further comprising the step of machining the body to a predetermined shape.

36. A magnet for use in a magnetic core, the magnet being made according to the method of claims 32 or 34.

37. A method of producing a multiple bar magnetic core, the core having a circumferential surface, comprising the steps of:

providing a plurality of bar magnets, the provision of each magnet comprising the steps of:

(a) forming a body of hard magnetic material having magnetic domains therein, and (b) magnetizing first and second pluralities of the magnetic domains to provide a first magnetic pole face and second and third generally mutually opposing magnetic pole faces, the first pole face being of a first polarity and located generally transverse to said second and third pole faces, the second and third pole faces being of a polarity opposite to that of the first pole face, and the first and second pluralities of domains being aligned along generally diverging curved paths between the first pole face and the second and third pole faces;

orienting the first magnetic pole face of each bar magnet at the core circumferential surface;

orienting the second and third magnetic pole faces of each magnet respectively adjacent to the second and third magnetic pole faces of adjacent bar magnets; and joining the oriented magnets together to form a rigid core.

38. The method of claim 37, wherein the joining step further comprises the step of attaching each bar magnet to a support at a selected one of a first retaining means on the support and a second complementary retaining means on the bar magnet.

39. A multiple bar magnetic core made according to the method of claim 37.

40. A magnet for a magnetic core, the magnet made by the process of:

forming a body of hard magnetic material having magnetic domains therein; and magnetizing first and second pluralities of the magnetic domains to provide a first magnetic pole face and second and third generally mutually opposing magnetic pole faces, the first pole face being of a first polarity and located generally transverse to said second and third pole faces, the second and third pole faces being of a polarity opposite to that of the first pole face, and the first and second pluralities of domains being aligned along generally diverging curved paths between the first pole face and the second and third pole faces.

41. A magnet for a magnetic core, the magnet made by the process of:

forming a body of hard magnetic material having having magnetic domains therein and having a first surface and second and third generally mutually opposing surfaces, the first surface being located generally transverse to the second and third surfaces;

positioning, with respect to the first, second, and third surfaces, magnetizing means operable for inducing magnetizing field lines along generally diverging curved paths between the first surface and the second and third surfaces; and activating the magnetizing means to magnetize the domains along the paths and to induce first, second, and third remanent magnetic pole faces respectively at the first, second, and third surfaces, the first pole face being of a first polarity and the second and third pole faces being of a polarity opposite to that of the first pole face.

* * * * *